US005987697A

United States Patent [19]

Song et al.

[11] Patent Number: 5,987,697

[45] Date of Patent: Nov. 23, 1999

[54] VACUUM CLEANER HAVING A BRUSH LAMP

[75] Inventors: Jung-Gon Song; Ki-Man Kim, both of Kwangju, Rep. of Korea

[73] Assignee: Kwangju Electronics Co., Ltd., Kwangju, Rep. of Korea

[21] Appl. No.: 08/926,049

[22] Filed: Sep. 9, 1997

[30] Foreign Application Priority Data

Sep. 10, 1996 [KR] Rep. of Korea ..... 96-28753
Sep. 10, 1996 [KR] Rep. of Korea ..... 96-28754

[51] Int. Cl.[6] ..... A47L 9/30

[52] U.S. Cl. ..... 15/324; 362/91; 362/307

[58] Field of Search ..... 15/324; 362/91, 362/296, 307

[56] References Cited

U.S. PATENT DOCUMENTS 4,757,574 7/1988 Sumerau ..... 15/324
4,939,629 7/1990 Glanton et al. ..... 362/307 X
5,107,565 4/1992 Chun ..... 15/324
5,519,594 5/1996 Wu ..... 362/307 X

*Primary Examiner*—Chris K. Moore
*Attorney, Agent, or Firm*—Perman & Green, LLP

[57] ABSTRACT

A vacuum cleaner having a suction nozzle lamp which can light and observe a forward are of a suction nozzle for collecting dust or alien substances without being overheated. A reflection plate with a predetermined shape is formed inside a lower case forming a suction nozzle with a suction opening for sucking dust or alien substances, and a window is formed at the forward area of the reflection plate and at the lower case to light the forward area after light is reflected by the reflection plate. A suction nozzle lamp is formed between the reflection plate and the window. A strip-type electric bulb is located between the reflection plate and the window by first and second terminals or a socket terminal, thereby emitting enough light to the forward area of the suction nozzle to perform cleaning without being overheated.

6 Claims, 3 Drawing Sheets

VACUUM CLEANER HAVING A BRUSH LAMP

BACKGROUND OF THE INVENTION

A. Field of the Invention

The present invention relates to a vacuum cleaner having a suction nozzle lamp. More particularly, the present invention relates to a vacuum cleaner having a suction nozzle lamp which can light and observe a forward area of a suction nozzle for collecting dust or alien substances without being overheated.

B. Description of the Related Art

Generally, a conventional suction nozzle lamp for a vacuum cleaner is a device by which a user can perform cleaning, observing easily a forward area of a suction nozzle for collecting dust of alien substances.

FIG. 1 is a view illustrating that a suction nozzle lamp is mounted in a suction nozzle.

A reflection plate 12 with a predetermined shape is formed inside a lower case 11 forming a suction nozzle 10, and a window 13 is formed at the forward area of the reflection plate 12 and at the lower case 11 to light the forward area after light is reflected by the reflection plate 12. A socket 14 connected to an electric wire 141 inserted into a hole 121 formed in the center of the reflection plate 12, m is fixed to a fixed projection 111 projected upward form a bottom of the lower case 11 at a predetermined interval. A electric bulb 15 is combined with the socket 14.

However, the conventional vacuum cleaner with the above electric bulb has a disadvantage in that it is not useful to perform the cleaning since the intensity of the light through the window 13 is weak, thereby failing to emit enough light to the forward area of the suction nozzle 10 to perform the cleaning. In addition, there is the risk of a fire cased by overheating when a user uses an electric bulb with higher watt to overcome the weak intensity of the electric bulb 15.

SUMMARY OF THE INVENTION

Accordingly, the object of the present invention is to provide a vacuum cleaner having a suction nozzle lamp which can light and observe a forward area of a suction nozzle for collecting dust or alien substances without being overheated, to substantially obviate one or more of the problems due to limitations and disadvantages of the related art.

To achieve the object and in accordance with the purpose of the invention, as embodied and broadly described herein, a vacuum cleaner having a suction nozzle lamp, wherein a reflection plate with a predetermined shape is located inside a lower case forming a suction nozzle with a suction opening for sucking dust or alien substances, a window is formed at a forward area of the reflection plate and at the lower case to light the forward area after light is reflected by the reflection plate, and a suction nozzle lamp is formed between the reflection plate and the window, the vacuum cleaner comprising:

a strip-type electric bulb serving as a suction nozzle lamp for emitting enough light to the forward area of the suction nozzle to perform cleaning:

a reflection plate and a window being fixed to the lower case by connection members with a predetermined shape; and first and second terminals having a predetermined shape and connected to electric wires and attached to the connection members so as to extend into an area defined by the reflection plate, the window and the connection members by means of locking means, the strip-type electric bulb being located in the first and the second terminals.

According to another aspect of the present invention, a vacuum cleaner having a suction nozzle lamp, wherein a reflection plate with a predetermined shape is located inside a lower case forming a suction nozzle with a suction opening for sucking dust or alien substances, a window is formed at a forward area of the reflection plate and at the lower case to light to forward area after light is reflected by the reflection plate, and the suction nozzle is formed between the reflection plate and the window, the vacuum cleaner comprising:

a strip-type electric bulb serving as the suction nozzle lamp for emitting enough light to the forward area of the suction nozzle to perform cleaning;

a reflection plate and a window being fixed to the lower case by the connection members with a predetermined shape; and socket terminals connected to electric wires and fixed on the lower case by means of a plurality of ribs symmetrically disposed ont he lower case between the reflection plate and the window at predetermined intervals, and the strip-type electric bulb being located in the socket terminal to light the forward area of the suction nozzle.

Additional objects and advantages of the invention are set forth in part in the description which follows, and in part will be obvious from the description, or may be learned by practice of the invention. The objects and advantages of the invention will be realized and attained by means of the elements and combinations particularly pointed out in the appended claims.

BRIEF DESCRIPTION OF THE DRAWINGS

The accompanying drawings, illustrate embodiments of the invention and, together with the description, serve to explain the principles of the invention.

In the drawings.

DESCRIPTION OF THE PREFERRED EMBODIMENTS

Reference will not be made in detail to preferred embodiments of the present invention, examples of which are illustrated in the accompanying drawings.

Figure 1:
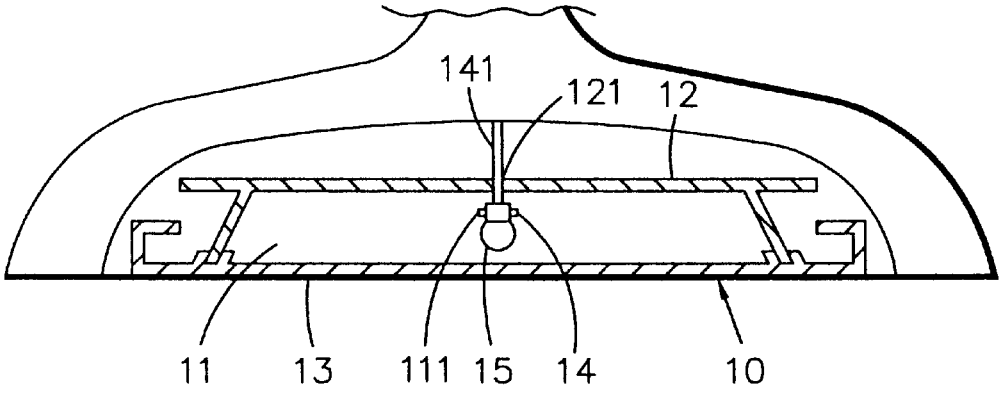
FIG. 1 (PRIOR ART)
FIG. 1 is a schematic view illustrating a construction of a conventional suction nozzle lamp.
Figure 2:
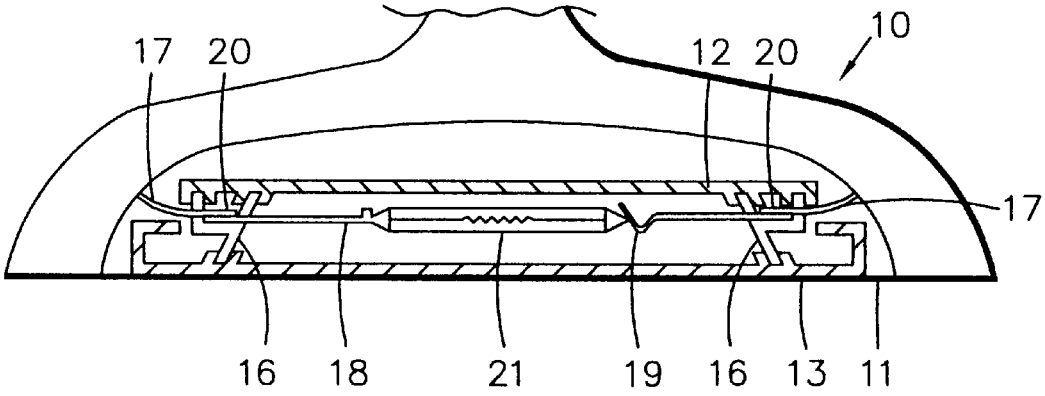
FIG. 2 is a schematic view illustrating a construction of a suction nozzle according to a first preferred embodiment of the present invention.
Figure 3:
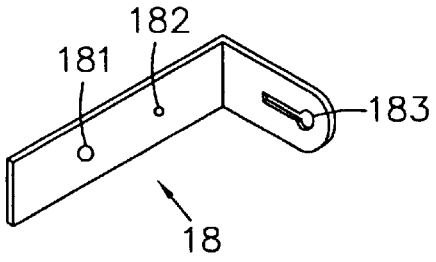
FIG. 3 is a perspective view of a first terminal of FIG. 2.
Figure 4:
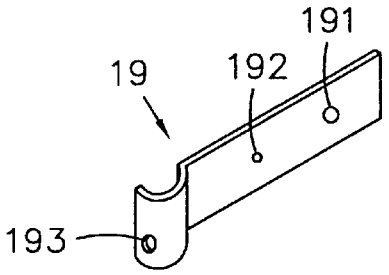
FIG. 4 is a perspective view of a second terminal of FIG. 2.

FIG. 2 is a schematic view illustrating a construction of a suction nozzle according to a first preferred embodiment of the present invention. FIG. 3 is a perspective view of a first terminal of FIG. 2, and FIG. 4 is a perspective view of a second terminal of FIG. 2. Same reference numerals are indicated to same portions as portions in FIG. 1, and explanation thereof is omitted.

The construction of a vacuum cleaner having a suction nozzle lamp according to the first preferred embodiment of the present invention is explained as follows.

A reflection plate 12 with a predetermined shape is located inside a lower case 11 forming a section nozzle 10 with a suction opening for sucking dust or alien substances, and a window 13 is formed at a forward area of the reflection plate 12 and at the lower case 11 to light the forward area after light is reflected by the reflection plate 12. A suction nozzle lamp is located between the reflection plate 12 and the window 13.

The suction nozzle lamp is a strip-type electric bulb which can emit enough light to the forward area of the suction nozzle to perform cleaning. The reflection plate 12 and the window 13 are fixed to the lower case 11 by connection members 16 with a predetermined shape. First and second terminals 18 and 19 having a predetermined shape and connected to electric wires 17 are attached to the connection members 16 by locking means 20 such as a screw so as to extend into an area formed by the reflection plate, the window 13 and the connection members 16. A strip-type electric bulb 21 is located in the first and the second terminals 18 and 19.

Here, the first terminal 18 has first and second holes 181 and 182 on one portion bent perpendicularly, thereby fixing the first terminal 18 to the connection member 16 by the locking means 20. A hole 183 for fixing the electric bulb and having a shape of a keyhole is formed in another portion to mount the strip-type electric bulb 21.

The second terminal 19 has first and second holes 191 and 192 on a straight portion,thereby fixing the second terminal 19 to the connection member 16 by the locking means 20. A hole 193 for mounting/dismounting the strip-type electric bulb 21 is formed on a bent portion in the second terminal 19.

Hereinafter, the operation and the effect of the vacuum cleaner having a suction nozzle lamp according to the first preferred embodiment of the present invention are explained in detail with reference wo the accompanying drawings.

The reflection plate 12 and the window 13 are fixed in the lower case 11 by the connection members 16. The first and the second terminals 18 and 19 connected to the electric wires 17 are attached to the connection members 16 by the locking means 20. The strip-type electric bulb 21 is located int he first and the second terminals 18 and 19 to emit enough light to the forward area of the suction nozzle to perform the cleaning. The light emitted from the strip-type electric bulb 21 is reflected by the reflection pl;ate 12 and lights the forward area of the suction nozzle through the window 13, whereby the user can easily observe the forward area of the suction nozzle and perform the cleaning effectively.

In addition, the user can easily mount/dismount the strip-type electric bulb 21 in the holes 183 and 193 int he first and the second terminals 18 and 19 since the first and the second terminals 18 and 19 connected to the connection members 16 are made of elastic material.

The connection members 16 are separated from the reflection plate 12 in the first preferred embodiment of the present invention, however, it is also preferable that the connection members 16 may be integrated with the reflection plate 12 supposing that the connection members 16 fix the first and the second terminals 18 and 19.

Figure 5:
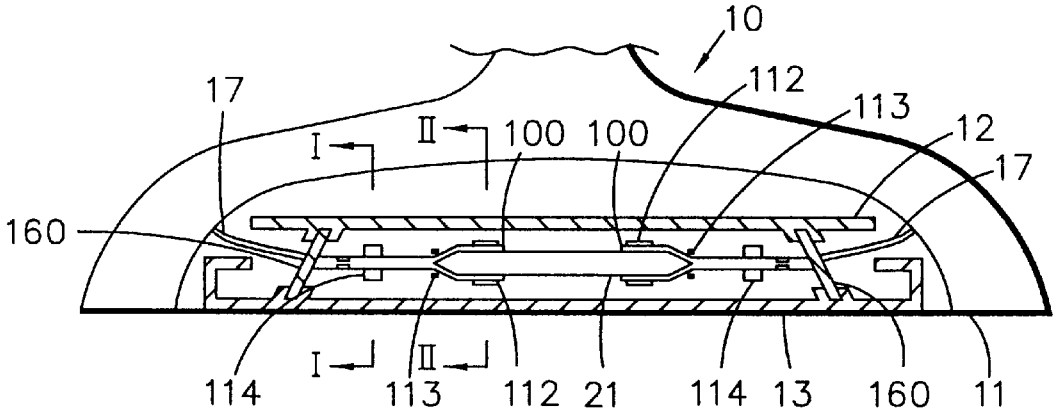
FIG. 5 is a schematic view illustrating a construction of a suction nozzle according to a second preferred embodiment of the present invention.
Figure 6:
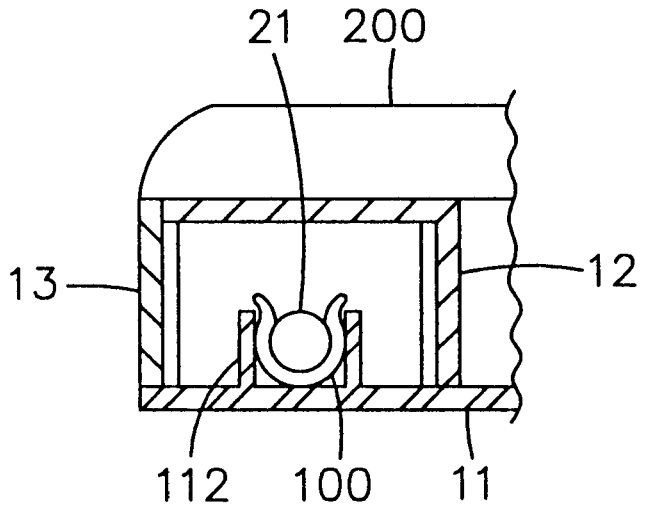
FIG. 6 is a cross-sectional view taken along line 1—1 in FIG. 5.
Figure 7:
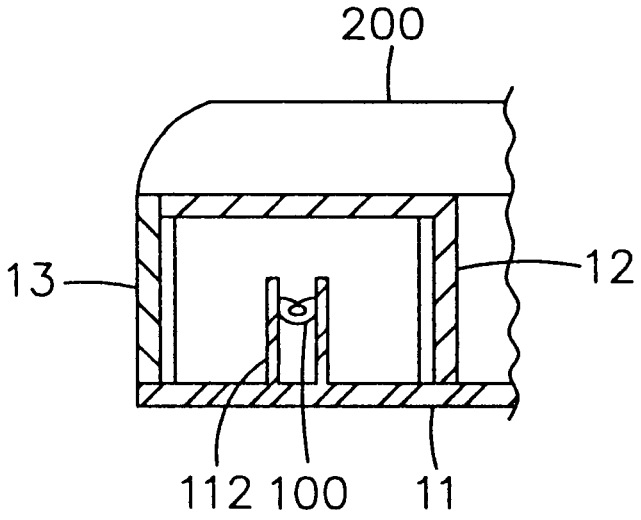
FIG. 7 is a cross sectional view taken along line 11—11 in FIG. 5.

FIG. 5 is a schematic view illustrating a construction of a suction nozzle according to a second preferred embodiment of the present invention.

The construction of a vacuum cleaner having a suction nozzle lamp according to the second preferred embodiment of the present invention is explained as follows.

A reflection plate 12 with a predetermined shape is located inside a lower case 11 forming a suction nozzle 10 with a suction opening for sucking dust or alien substances, and a window 13 is formed at a forward area of thee reflection plate 12 and at the lower case 11 to light the forward area after light is reflected by the reflection plate 12. A suction nozzle lamp is located between the reflection plate 12 and the window 13.

The suction nozzle lamp is a strip-type electric bulb which can emit enough light to the forward area of the suction nozzle to perform the cleaning. The reflection plate 12 and the window 13 are fixed tot he lower case 11 by the connection members 160 with a predetermined shape. Socket terminals 100, connected to electric wires 17 inserted under the connection members 160, are fixed on the lower case by means of a plurality of ribs 112, 113 and 114 symmetrically disposed between the reflection plate 12 and the window 13 at predetermined intervals. A strip-type electric bulb 21 is located in the socket terminal 100 to light the forward area of the suction nozzle 10.

Here, the socket terminal 100 has a cylindrical shape having a top portion which is open and into which the strip-type electric bulb 21 is mounted. Respective portions to which the electric wires 17 are connected, are inward bent and cocked to fix the electric wires 17.

The connection members 160 for connecting the reflection plate 12 and the window 13 prevents the light from leaking. In addition, the connection members 160 are separated from the reflection plate 12 and the window 13, but it is also preferable that the connection members 160 are integrated with the reflection plate 12 in one body.

A reference numeral 200, which is not explained, indicated an upper case forming the suction nozzle 10.

Hereinafter, the operation and the effect of the vacuum cleaner having a suction nozzle lamp according to the second preferred embodiment of the present invention are explained in detail with reference to the accompanying drawings.

The reflection plate 12 and the window 13 are fixed on the lower case 11, and the socket terminal 100 connected to the electric wires 17 is fixed by a plurality of ribs 112, 113 and 114. The strip type electric bulb 21 is formed int he socket terminal 100 to emit enough light to the forward area of the suction nozzle 10 to perform the cleaning. The light emitted from the strip-type electric bulb 21 is reflected by the reflection plate 12 and lights the forward area of the suction nozzle through the window 13, whereby the user can easily observe the forward area of the suction nozzle and perform the cleaning effectively.

In addition, it is preferable that the reflection plate 12 is combined with the window 13 after fixing the socket terminal 100 connected to the electric wires 17 to a plurality of ribs 112, 113 and 114 when the connection members 160 are separated form the reflection plate 12.

As described above, the first and the second terminals 18 and 19 for connecting the electric wires 17 are connected to the connection members 16 for connecting the reflection plate 12 and the window 13, and the strip-type electric bulb 21 is located in the first and the second terminals 18 and 19 to emit enough light to the forward area of the suction nozzle 10 to perform the cleaning. Accordingly, the strip-type electric bulb 21 lights the forward area of the suction nozzle 10 through the window 13 without being overheated, whereby the user can easily observe the forward area of the suction nozzle and perform the cleaning effectively.

In addition, the socket terminals 100 are fixed in a plurality of fixed ribs 112, 113 and 114 symmetrically disposed between the reflection plate 12 and the window 13 at and projected to predetermined the intervals. The strip-type electric bulb 21 is located int he socket terminal 100 to light the forward area of the suction nozzle 10 through the window 13 without being overheated, whereby the user can easily observe toe forward area of the suction nozzle and perform the cleaning effectively.

Other embodiments of the invention will be apparent to the skilled int he art from consideration of the specification and practice of the invention disclosed herein. It is intended that the specification and examples be considered as exemplary only, with the true scope and spirit of the invention being indicated by the following claims.

We claim:

1. A vacuum cleaner having a suction nozzle lamp, wherein a reflection plate with a predetermined shape is located inside a lower case forming a suction nozzle with a suction opening for sucking dust or alien substances, said vacuum cleaner further having a window formed at a forward area of the reflection plate and at the lower case to light the forward area after light is reflected by the reflection plate, and the suction nozzle lamp located between the reflection plate and the window, said vacuum cleaner comprising:

a strip-type electric bulb serving as the suction nozzle lamp for emitting enough light to the forward area of the suction nozzle to perform cleaning;

the reflection plate and the window being fixed to the lower case by connection members having a predetermined shape; and first and second terminals having a predetermined shape and connected to electric wires and attached to the connection members so as to extend into an area defined by the reflection plate, the window and the connection member by means of locking means for connecting the first and second terminals to said connection members, said strip-type electric bulb being located in the first and the second terminals.

2. The vacuum cleaner having a suction nozzle brush lamp of claim 1, wherein the first terminal as one portion and another portion and a plurality of holes in the one portion thereof to fix itself to one of the connection members by the locking means, and a mounting hole for mounting the strip-type electric bulb on the other portion thereof.

3. The vacuum cleaner having a suction nozzle lamp of claim 1, wherein the second terminal has a straight portion and a bent portion and a plurality of holes on the straight portion thereof to fix itself to one of the connection members by the locking means, and a hole for mounting/dismounting the strip-type electric bulb on the bent portion thereof.

4. A vacuum cleaner having a suction nozzle lamp, wherein a reflection plate with a predetermined shape is located inside a lower case forming a suction nozzle with a suction opening for sucking dust or alien substances, said vacuum cleaner further having a window formed at a forward area of the reflection plate and at the lower case to light the forward area after light is reflected by the reflection plate, and the suction nozzle lamp located between the reflection plate and the window, said vacuum cleaner comprising:

a strip-type electric bulb serving as the suction nozzle lamp for emitting enough light to the forward area of the suction nozzle to perform cleaning:

the reflection plate and the window being fixed to the lower case by connection members having a predetermined shape; and socket terminals connected to electric wires and fixed on the lower case by means of a plurality of ribs symmetrically disposed on the lower case between the reflection plate and the window at predetermined intervals, and the strip-type electric bulb being located in the socket terminal to light the forward area of the suction nozzle.

5. The vacuum cleaner having suction nozzle lamp of claim 4, wherein the socket terminal has a cylindrical shape having a top portion which is open and into which the strip-type electric bulb is mounted, and respective portions to which the electric wires are connected, are inward bent and cocked to fix the electric wires.

6. The vacuum cleaner having the suction nozzle lamp of claim 4, wherein the connection members are incorporated with the reflection plate.

* * * * *